US009725861B2

(12) United States Patent
Winters et al.

(10) Patent No.: US 9,725,861 B2
(45) Date of Patent: Aug. 8, 2017

(54) SNOW-TO-SLURRY CONVERSION APPARATUS

(71) Applicants: Cam Winters, Edmonton (CA); James Clark Hogan, Calgary (CA); Kelly Winters, Edmonton (CA)

(72) Inventors: Cam Winters, Edmonton (CA); James Clark Hogan, Calgary (CA); Kelly Winters, Edmonton (CA)

( * ) Notice: Subject to any disclaimer, the term of this patent is extended or adjusted under 35 U.S.C. 154(b) by 53 days.

(21) Appl. No.: 14/744,357

(22) Filed: Jun. 19, 2015

(65) Prior Publication Data

US 2016/0369468 A1 Dec. 22, 2016

(51) Int. Cl.
*E01H 5/10* (2006.01)
*E01H 5/06* (2006.01)

(52) U.S. Cl.
CPC ..... *E01H 5/104* (2013.01); *E01H 5/061* (2013.01); *E01H 5/102* (2013.01)

(58) Field of Classification Search
CPC E01H 5/07; E01H 5/102; E01H 5/104; E01H 5/098; E01H 5/061
USPC ..... 37/227, 228, 229
See application file for complete search history.

(56) References Cited

U.S. PATENT DOCUMENTS 734,195 A * 7/1903 Riedel ..... E01H 5/102 126/343.5 R
929,737 A * 8/1909 Weismantel ..... E01B 27/06 104/279
977,109 A * 11/1910 Lux ..... E01H 5/104 126/343.5 R
1,351,542 A * 8/1920 Ryan ..... E01H 5/104 126/343.5 R
2,178,400 A * 10/1939 Marino ..... E01H 5/104 126/343.5 A
3,036,391 A * 5/1962 Kemp ..... 126/343.5 R
3,066,428 A * 12/1962 Raiti ..... E01H 5/104 126/343.5 R
3,140,708 A * 7/1964 Petlak ..... E01H 5/102 126/343.5 R
3,304,632 A * 2/1967 Kotlar ..... E01H 5/104 126/343.5 R
3,309,798 A 3/1967 Devlin et al.
(Continued)

FOREIGN PATENT DOCUMENTS

CA 1317318 C 5/1993
CN 201908275 U 7/2011
(Continued)

*Primary Examiner* — Jamie L McGowan

(57) ABSTRACT

A snow-to-slurry conversion apparatus can include a chassis, a collection device, a holding tank, a conveying system, and a spraying system. The collection device can be mounted on the chassis and extend between a collection inlet to a collection outlet. The holding tank can be mounted on the chassis. The holding tank can include a tank inlet and a tank outlet. The conveying system can extend between a conveying inlet communicating with the collection outlet and a conveying outlet communicating with the tank inlet. The spraying system can extend along the conveying system between the conveying inlet and the conveying outlet. The conveying system can extend along a tortured path and include a plurality of sections extending in opposite directions. The spraying system can include spray jets disposed along the plurality of sections extending in opposite directions.

14 Claims, 8 Drawing Sheets

(56) References Cited

U.S. PATENT DOCUMENTS

| | | | | | |
|---|---|---|---|---|---|
| 3,333,354 | A | | 8/1967 | Kirshenblat | |
| 3,452,459 | A | | 7/1969 | Campion | |
| 3,766,586 | A | | 10/1973 | Krickovich | |
| 4,050,169 | A | | 9/1977 | Pasquier | |
| 4,071,966 | A | * | 2/1978 | Cohen | E01H 5/104 193/31 A |
| 4,226,034 | A | | 10/1980 | Benjamin et al. | |
| 4,353,176 | A | * | 10/1982 | Hess | E01H 5/104 126/343.5 R |
| 4,615,129 | A | | 10/1986 | Jackson | |
| 5,365,681 | A | * | 11/1994 | Miranda | E01H 5/104 37/199 |
| 5,469,645 | A | * | 11/1995 | Aiken | E01H 5/104 210/743 |
| 6,305,105 | B1 | | 10/2001 | Lowman | |
| 7,814,898 | B2 | * | 10/2010 | Rumbaugh | E01H 5/102 126/271.1 |
| 2007/0006874 | A1 | * | 1/2007 | Potter | E01H 5/102 126/343.5 R |
| 2014/0305010 | A1 | * | 10/2014 | Fonseca | E01H 5/104 37/228 |

FOREIGN PATENT DOCUMENTS

| | | | |
|---|---|---|---|
| CN | 202017187 | U | 10/2011 |
| DE | 4237022 | A1 | 5/1994 |

* cited by examiner

SNOW-TO-SLURRY CONVERSION APPARATUS

BACKGROUND

1. Field

The present disclosure relates to a mobile unit for collecting and melting snow.

2. Description of Related Prior Art

U.S. Pat. No. 3,766,586 discloses an invention titled SNOW REMOVAL AND VACUUM SWEEPER WITH SLURRY DISPOSAL. The '586 patent discloses a fluid containing insulated reservoir or tank mounted on a vehicle chassis having an engine thereon, a hydraulic pressure means and a control cab. A roadway cleaning apparatus, comprising a forwardly open horizontally disposed substantially cylindrical screw conveyor surrounding housing, is pivotally mounted transversely of the forward end portion of the vehicle chassis for vertical pivoting movement about a horizontal axis. A discharge tube connects the central portion of the conveyor housing to the tank. Heat transfer means supported by the chassis extends into the tank for heating contained slurry and melting snow. An agitator within the tank forms a slurry of the materials contained by the tank.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A snow-to-slurry conversion apparatus can include a chassis, a collection device, a holding tank, a conveying system, and a spraying system. The chassis can extend along a longitudinal axis between a front end and a rear end. The collection device can be mounted on the chassis and extend between a collection inlet to a collection outlet. The holding tank can be mounted on the chassis and be spaced from the collection device. The holding tank can include a tank inlet and a tank outlet. The conveying system can extend between a conveying inlet communicating with the collection outlet and a conveying outlet communicating with the tank inlet. The spraying system can extend along the conveying system between the conveying inlet and the conveying outlet. The conveying system can extend along a tortured path and include a plurality of sections extending in opposite directions. The spraying system can include spray jets disposed along the plurality of sections extending in opposite directions.

BRIEF DESCRIPTION OF THE DRAWINGS

The detailed description set forth below references the following drawings.

DETAILED DESCRIPTION

The present disclosure, as demonstrated by the exemplary embodiment described below, can provide equipment used to bring snow off of the street and convert the snow to a slurry that can be pumped. The equipment can be sized to the job required and can be mounted on or pulled by equipment already existing in most city fleets or can be self-propelled. The snow can be conveyed from the street to a crusher to pulverize larger pieces and augered through tubes that have jetted hot water flowing through them. The snow/slurry mix can then be either held in a containment on a first unit to be melted further and have the grit removed from it or pumped to a tanker or second unit that is being pulled behind for further heating and hauled away for disposal. The heat needed to accomplish this can be created with resistive and/or inductive heating methods. The energy necessary for this can be created by an onboard generator. These could be sized according to the size of the equipment and the amount of snow being handled. There could also be an onboard generator on the trailer to further melt the snow to aid in separation of grit and to make pumping off easier. All electrical equipment and operators cab could be isolated by means of isolation mounts and "boxed" in isolated containment units. All controls could be through programmable logic controllers (PLCs) from the operators cab. All units could be "plug and play" to ease transferring the units from one piece of equipment to another.

Units according to one or more exemplary embodiments of the present disclosure can make snow removal more efficient, cheaper, more environmentally friendly, and safer. The units can be sized for sidewalks, parking lots and streets. They could be sized for small ride on units, pickups, tractors, graders or loaders depending on snow load and job size. The units would cut down on city snow removal budgets, equipment maintenance due to less hours on equipment, make more use and more efficient use of the equipment already in fleet, and would make it safer on the streets by eliminating snow mounds, windrows and multiple pieces of equipment performing the same task that could be done by one. It would also eliminate the snow mountains and the hazards they present to operators and people who can't resist walking on and inspecting them.

Figure 1:
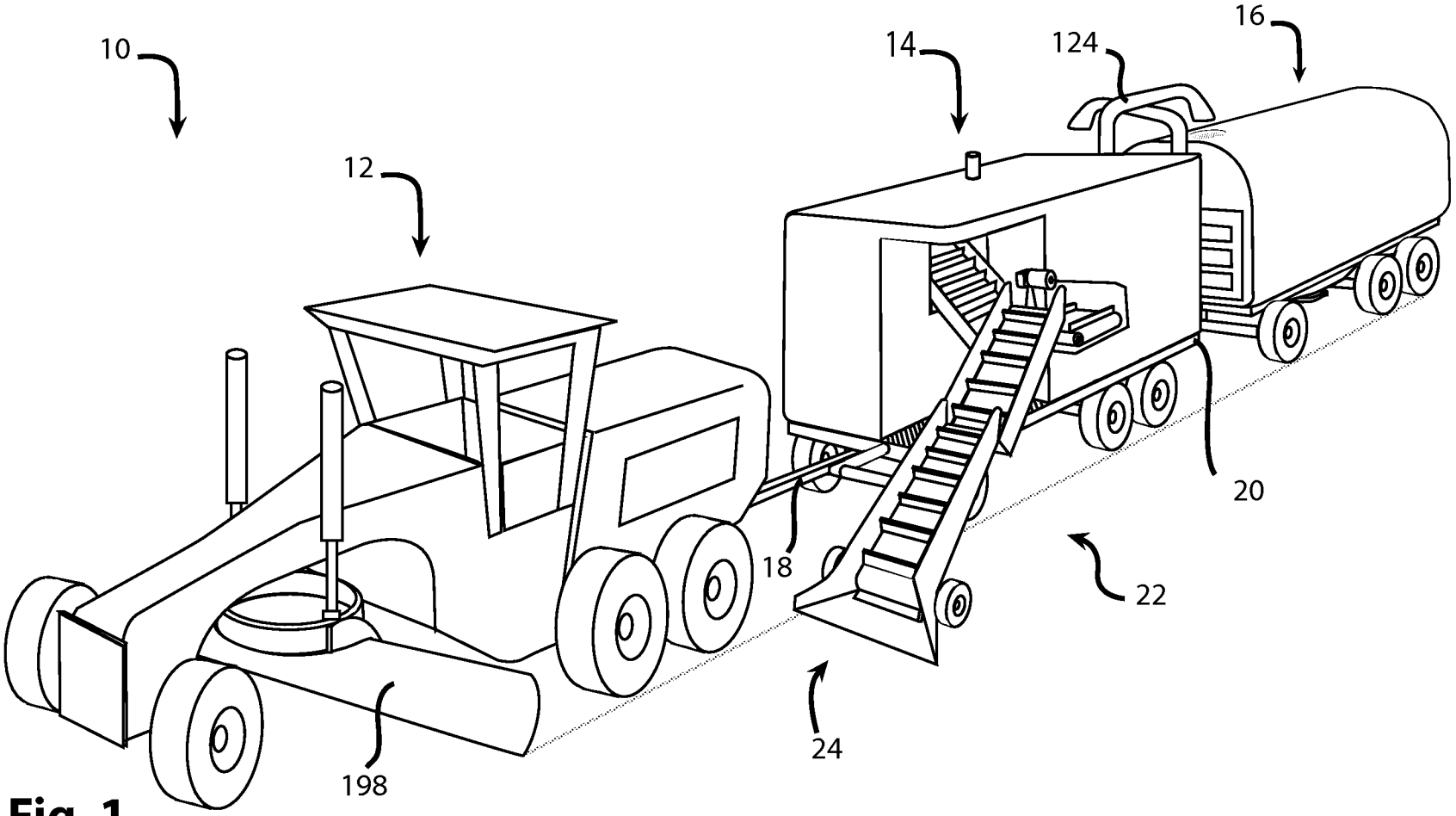
FIG. 1 is a perspective view of an exemplary embodiment of the present disclosure.
Figure 2:
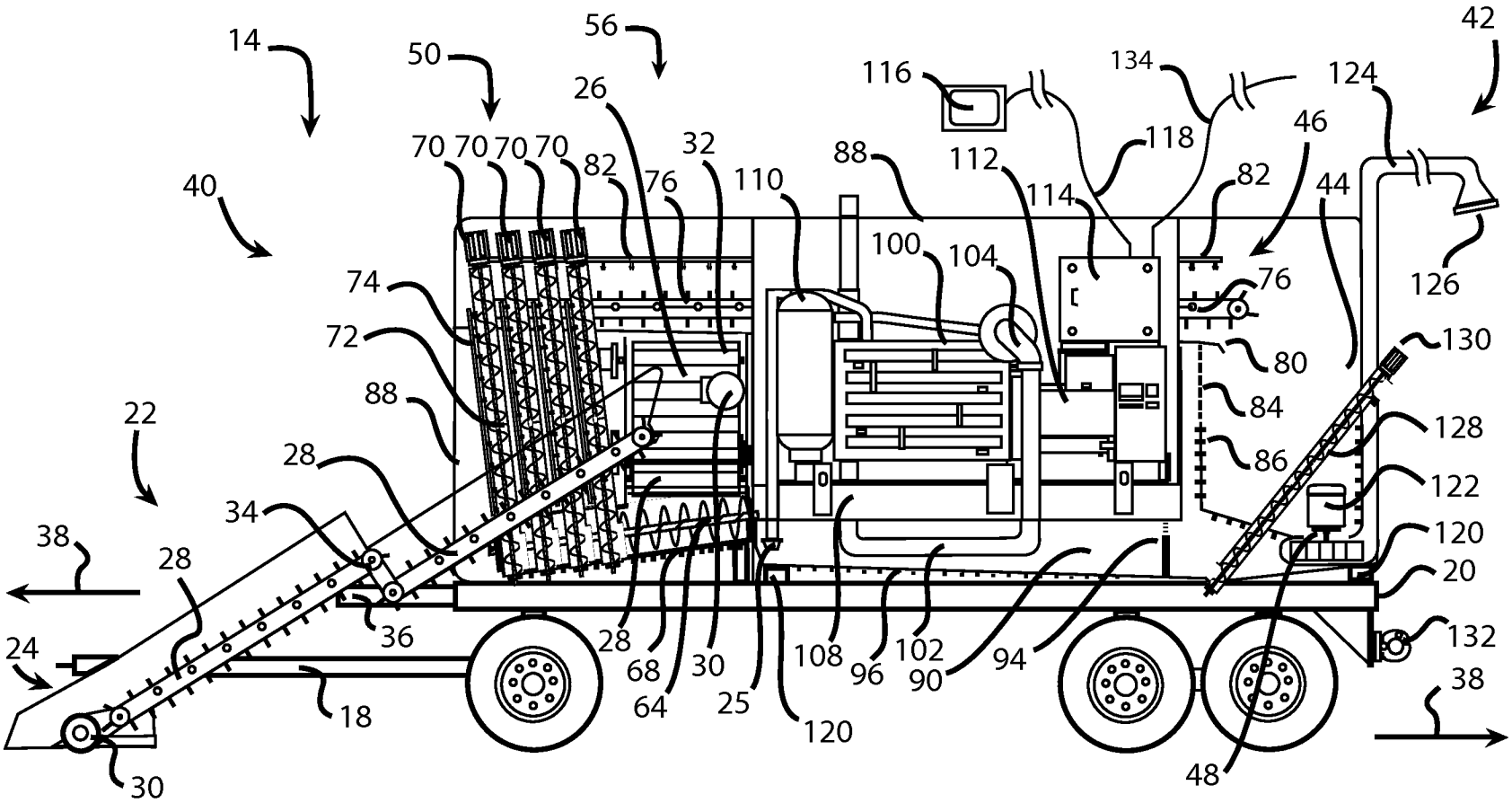
FIG. 2 is a right side view of a processing unit of the exemplary embodiment shown in FIG. 1 with enclosing panels rendered transparent to reveal the internal components of the processing unit.
Figure 3:
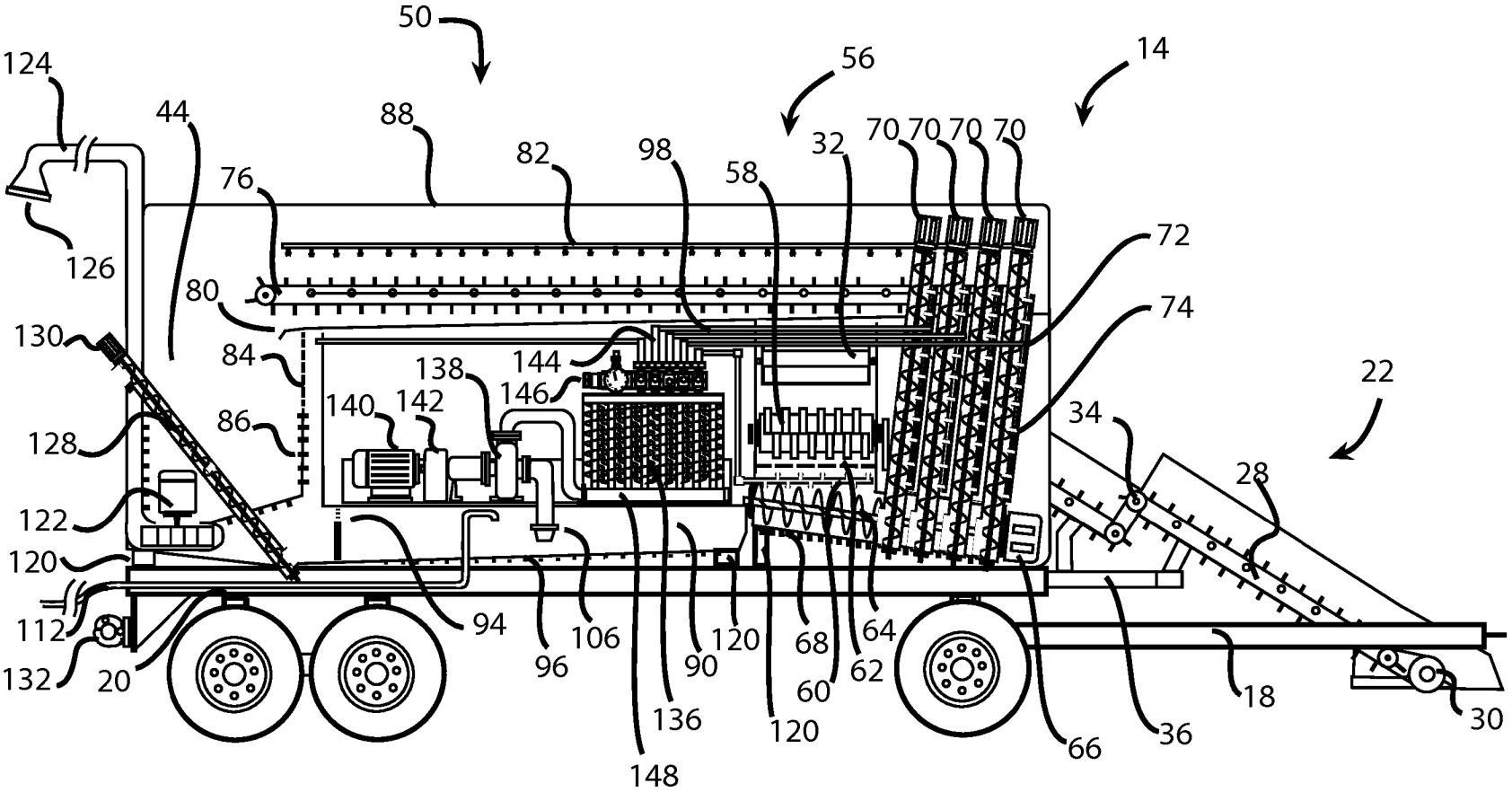
FIG. 3 is a left side view of the processing unit of the exemplary embodiment shown in FIGS. 1 and 2 with enclosing panels rendered transparent to reveal the internal components of the processing unit.

FIG. 1 is a perspective view of an exemplary embodiment of a snow-to-slurry conversion apparatus 10 according to the present disclosure. The embodiment 10 includes a grader 12, a processing unit 14, and a tanker unit 16. The tanker unit 16 can be hitched to the processing unit 14, such as through a hitch receiver 132 on the processing unit 14 and a trailer tongue 158 on the tanker unit 16. The processing unit 14 can be hitched to the grader 12 through a hitch receiver (not visible) on the grader 12 and a trailer tongue 18 on the processing unit 14. The grader 12 can thus pull the processing unit 14 and the tanker unit 16.

The processing unit 14 can include a chassis 20 and a collection device 22 mounted on the chassis 20. The interior of the processing unit 14 can be enclosed by a plurality of access panels, such as panels referenced at 88. The various components of the processing unit 14 can be supported on vibration isolation mounts, such as referenced at 120. The chassis 20 can extend along a longitudinal axis 38 between a front end 40 and a rear end 42.

The collection device 22 can extend between a collection inlet 24 and a collection outlet 26. As shown in FIG. 1, the collection inlet 24 is positionable to align with an edge of a blade 198 of the grader 12. The collection device 22 can include folding, pick-up conveyor sections 28. The collection device 22 can also include drive units for various conveyor sections 28, such as drive units referenced at 30. A portion of the collection device 22 referenced at 32 can be a crusher delivery section. The collection device 22 can include any number of tensioners, such a tensioner 34, and a pick-up frame, such as pick-up frame 36.

The processing unit 14 can also include a holding tank 44. The holding tank 44 can be mounted on the first chassis 20 and be spaced from the collection device 22. The holding tank 44 can include a tank inlet 46 and a tank outlet 48.

The processing unit 14 can also include a conveying system 50 extending between a conveying inlet 52 communicating with the collection outlet 26 and a conveying outlet 54 communicating with the tank inlet 46. The processing unit 14 can also include a spraying system 56 extending along the conveying system 50 between the conveying inlet 52 and the conveying outlet 54. As detailed below, the conveying system 50 can extend along a tortured path and include a plurality of sections extending in opposite directions. The spraying system 56 can include spray jets disposed along the plurality of sections that extend in opposite directions.

Figure 4:
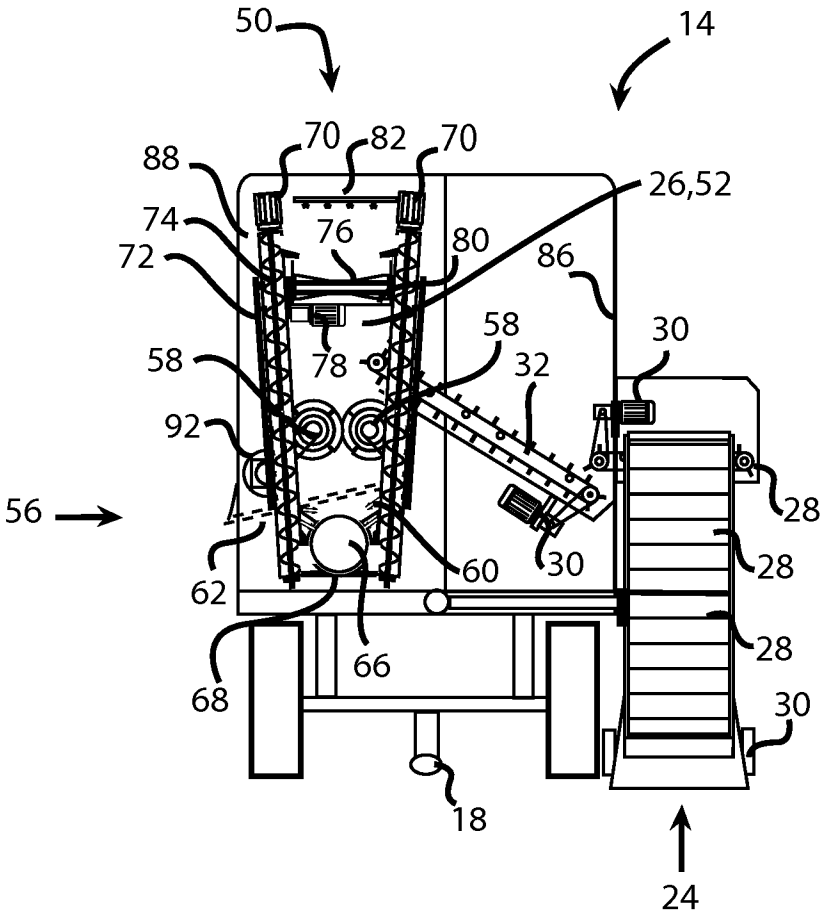
FIG. 4 is a front view of the processing unit of the exemplary embodiment shown in FIGS. 1-3 with a front panel rendered transparent to reveal the internal components of the processing unit.
Figure 5:
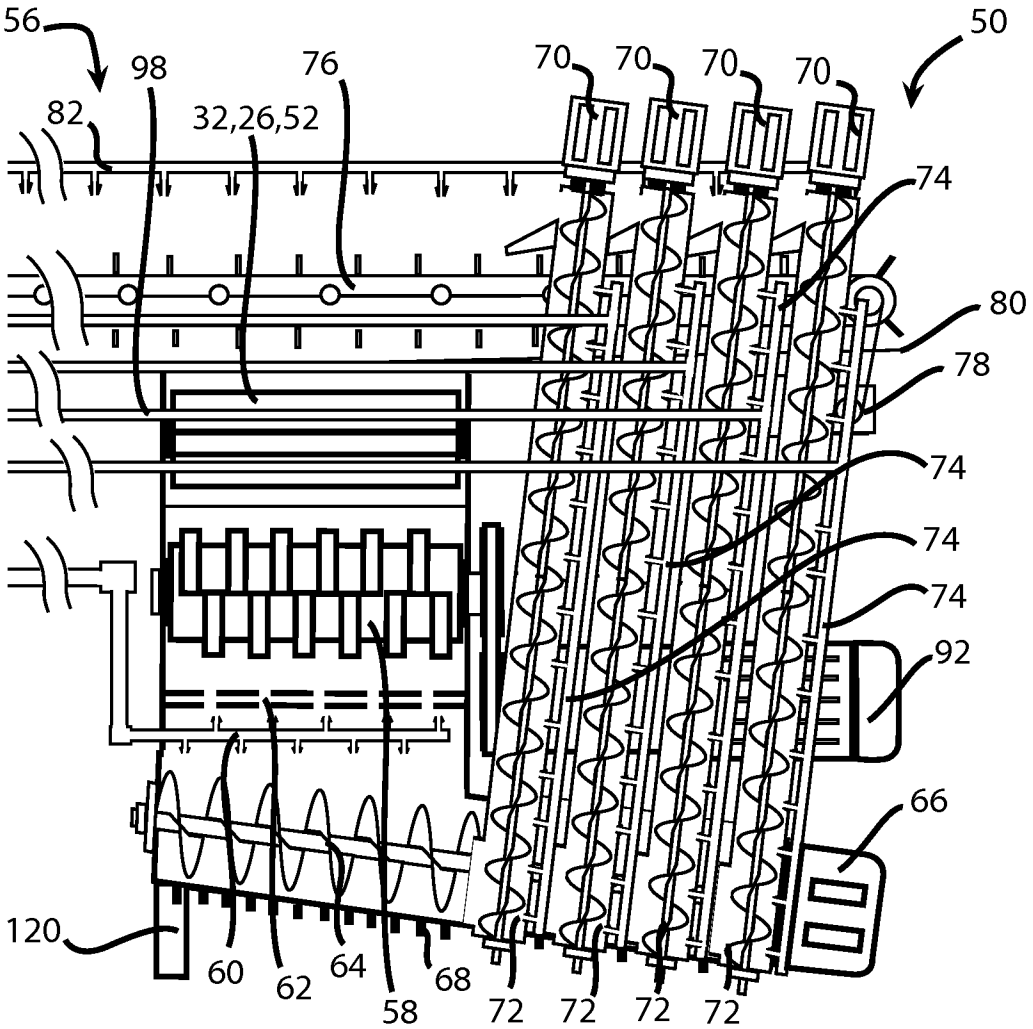
FIG. 5 is a magnified portion of FIG. 3.
Figure 6:
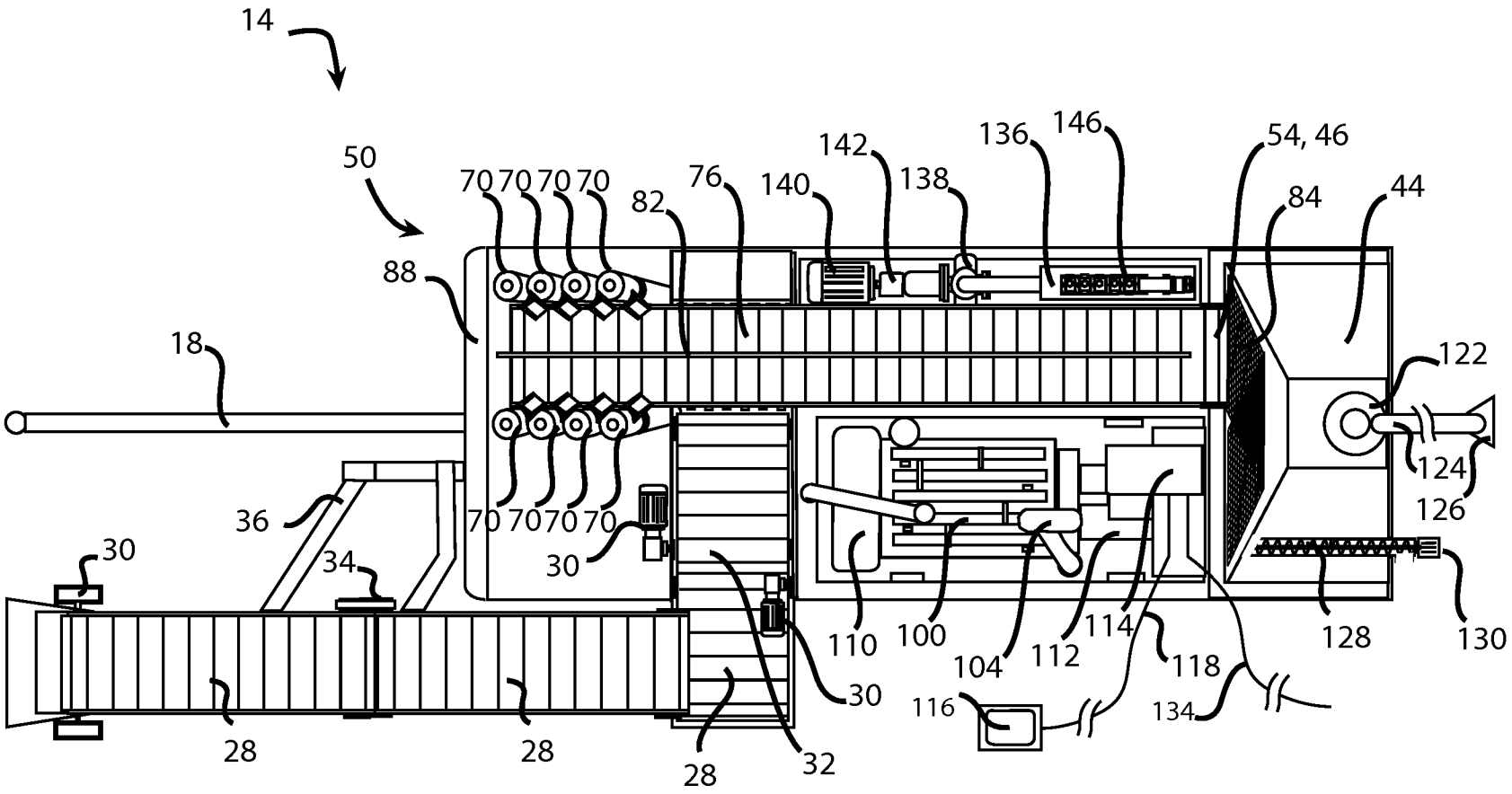
FIG. 6 is a top view of the processing unit of the exemplary embodiment shown in FIGS. 1-5 with a top panel rendered transparent to reveal the internal components of the processing unit.

The conveying system 50 can include a first section that is a chute directing downward movement of snow. As best shown in FIG. 4, snow can fall from an end of the crusher delivery section 32 and into the first section of the conveying system 50. A crusher can be disposed along the first section, such a crusher having crushing wheels referenced at 58. The crushing wheels 58 can be driven in rotation by a motor 92. Spray jets referenced at 60 of the spraying system 56 can be disposed along the first section to begin the process of forming a slurry with the snow. A filter or screen 62 can be disposed below the crusher to collect rocks and other debris.

The conveying system 50 can also include a second section that is a horizontally-oriented moving device. The exemplary second section can be an auger 64. The auger 64 is generally oriented horizontally. The auger 64 can be driven by a motor 66. The auger 64 can receive the snow passing through the crushing wheels 58 and direct the snow toward the front end 40 of the first chassis 20. Spray jets 60 of the spraying system 56 can be disposed along the second section to continue the process of forming a slurry with the snow. As the snow moves along the conveying system 50, the amount of snow in the slurry will diminish. Resistive heating elements 68 can be positioned on a sleeve of the auger 64 to further promote melting of the snow and formation of the slurry.

The conveying system 50 can also include a third section that is a vertically-oriented moving device. The third section can include a moving device configured to direct the snow-water mixture upward. The exemplary third section can be a plurality of augers, each referenced at 72. The augers 72 can receive the snow-water mixture from the auger 64. Each of the augers 72 can be driven in rotation by a motor, each referenced at 70. Spray jets referenced at 74 of the spraying system 56 can be disposed along the third section to continue the process of forming the slurry with the snow. Fluid lines 98 can direct water to the spray jets 74.

The conveying system 50 can also include a fourth section that is a horizontally-oriented moving device. The exemplary second section can be a conveyor 76. The conveyor 76 is generally oriented horizontally. The conveyor 76 can be driven by a motor 78. The conveyor 76 can receive the snow-water mixture from the augers 72 and direct the snow-water mixture toward the rear end 42 of the chassis 20. Spray jets referenced at 82 of the spraying system 56 can be disposed along the fourth section to continue the process of forming a slurry from the snow.

The conveying outlet 54 is disposed at the end of the conveyor 76. A trough 80 can be positioned under the conveyor 76 to catch fluid. Snow and water moved by the conveyor 76 and directed in movement by the trough 80 can fall into the holding tank 44.

As noted above, the conveying system 50 can extend along a tortured path. The second section and the fourth section, for example, extend in opposite horizontal directions and are stacked with respect to one another (the fourth section overlying the second section). The first section and the third section extend in opposite vertical directions and are adjacent to one another along the longitudinal axis 38. The fourth section extends over the second section and the first section. The third section includes moving devices in the form of augers 72 that are disposed in parallel and spaced from one another.

The snow-water mixture can fall into the holding tank 44 after passage through the conveying system 50. A screen 84 can allow excess water to pass out of the holding tank 44 and be scavenged for reuse. Resistive heating elements 86 can be positioned on the holding tank 44 to promote melting of the snow.

The processing unit 14 can also house a water scavenging and heating system. Water can pass out of the holding tank 44, through the screen 84, and into a nurse tank 90. A nurse tank weir 94 can limit the space that debris may accumulate within the nurse tank 90. Resistive heating elements 96 can be positioned on the nurse tank 90 to promote heating of the water. It is noted that the spray water heat exchange system, in one or more embodiments of the present disclosure, can be powered by electric (resistive or induction) and/or fossil fuel burners (such as diesel, coal, gasoline or any other fuel).

An engine 100 can be positioned on the processing unit 14. A fuel tank 108 of the engine 100 can also be positioned on the processing unit 14. Exhaust from the engine 100 can be directed through a pipe 102 of an exhaust system 104. The pipe 102 can extend through the nurse tank 90 to promote heating of the water.

The engine 100 can also be cooled with water from the nurse tank 90. Water can be drawn from the nurse tank 90 through an inlet 25 for cooling the engine using water in the nurse tank 90. The water can pass to a tank heat exchanger 110, allowing water to extract heat from the coolant passing through the engine 100. The water can return to the nurse tank 90 after absorbing heat through an outlet (not shown) communicating with the nurse tank 90. The heat exchanging system can also include a pump 138 for directing the water through the heat exchanger 136 by way of an intake 106 and supplying water to a header assembly 148. The pump 138 can be driven by a motor 140 and a drive coupling 142. Outlet header system piping 144 extending from an outlet header assembly 146 can direct the hot water to the piping of the spraying system 56. Thus, the intake 106 can be the intake for the spraying system 56 and the pump 138 can drive water through the spraying system 56.

The engine 100 can drive a generator 112 for powering the various motors and resistive and/or induction heating methods. The generator 112 can be operated and controlled through a control panel 114. The control panel 114 can electronically communicate with a PLC unit 116 over a line 118. The control panel 114 can electronically communicate with components in the tanker unit 16 over a line 134.

The snow slurry not scavenged can be directed to the tanker unit 16. An evacuation pump 122 can be positioned at the outlet 48 of the holding tank 44. The evacuation pump 122 can direct the snow slurry through a pump-out line 124 and out a nozzle 126. Debris in the nurse tank 90 can be removed with an auger 128 driven in rotation by a motor 130.

Figure 7:
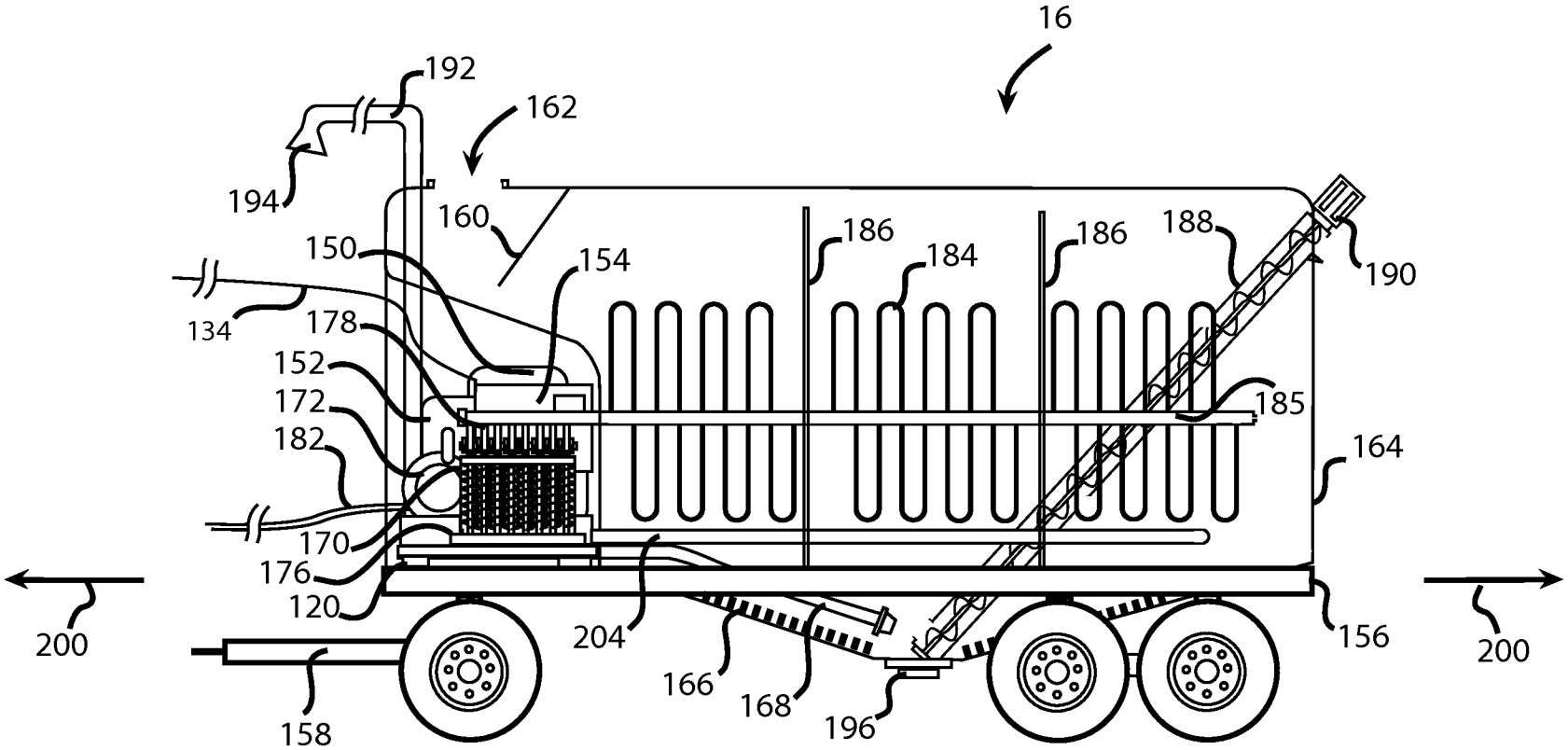
FIG. 7 is a right side view of a tanker unit of the exemplary embodiment shown in FIG. 1 with enclosing panels rendered transparent to reveal the internal components of the tanker unit.
Figure 8:
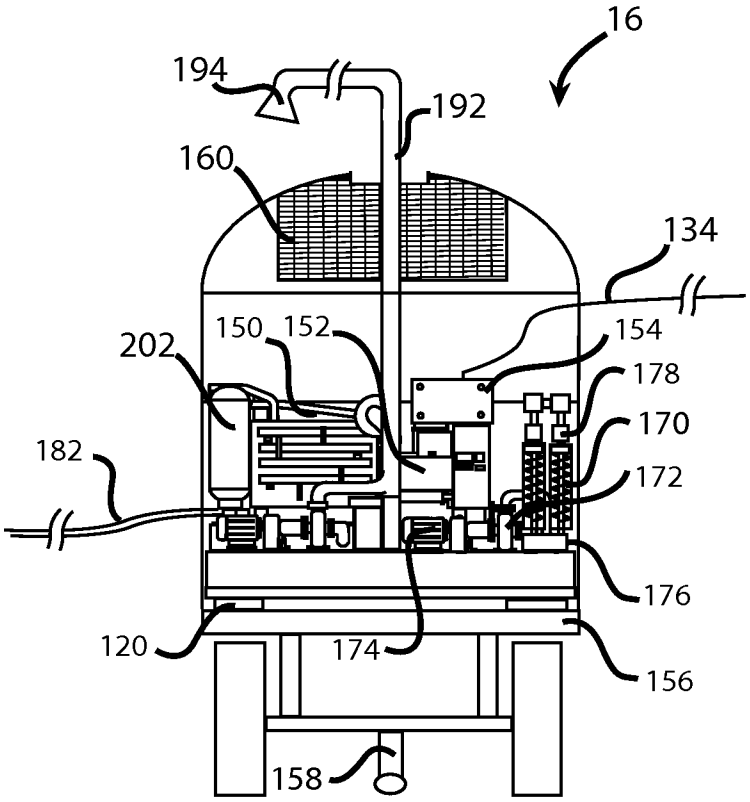
FIG. 8 is a front view of the tanker unit of the exemplary embodiment shown in FIGS. 1 and 7 with a front panel rendered transparent to reveal the internal components of the tanker unit.

The snow slurry directed out of the holding tank 44 can be passed for storage and transport to the tanker unit 16, shown best in FIGS. 7 and 8. The tanker unit 16 can extend along an axis 200. The tanker unit 16 can include a chassis 156 and house an engine 150 and a generator 152 driven by the engine 150. The generator 152 can be operated and controlled through a control panel 154. The control panel 154 can electronically communicate with the PLC unit 116 over the line 134. Alternatively, the control panel 154 can be a PLC unit positioned on the tanker unit 16. The generator 152 can deliver electrical power to various motors and heat resistive and/or induction heating methods.

At the inlet 162 a deflector screen 160 can be positioned to aid in the separation of grit and to break up heavy slurry. A vertical gap can be defined between the inlet 162 and the nozzle 126. The snow/water mixture contained in the tank 164 can be circulated through a heat exchange system 170 by a pump system 172 driven by motor 174. The water can enter the heat exchanger 170 through an intake header 176 and exit the heat exchanger 170 through an output header 178. The snow/water mixture in tank 164 can also be heated by scavenged heat from the motor 150 through heat exchange system 206 for the exhaust and heat exchange system 204 for the motor 150 coolant. If desired, water from the tanker unit 16 can be directed back the processing unit 14 through a fluid line 182.

Heated water can be dispersed through the interior of the holding tank 164 through a network of perforated piping or spray jets, such as referenced at 184 and 185. Baffles can be disposed in the interior of the holding tank 164 to inhibit the sloshing of water during movement of the tanker unit 16. Exemplary baffles are referenced at 186. Debris in the holding tank 164 can be removed with an auger 188 driven in rotation by a motor 190.

Water can be evacuated from the holding tank 164 by being pumped through a pump-out line 192 having a nozzle 194, or through a dump valve 196 positioned at the bottom of the holding tank 164. The tanker unit 16 can include one or more pumping systems to move water and slurry.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. Further, the "present disclosure" as that term is used in this document is what is claimed in the claims of this document. The right to claim elements and/or subcombinations that are disclosed herein as other present disclosures in other patent documents is hereby unconditionally reserved.

What is claimed is:

1. A snow-to-slurry conversion apparatus comprising:

a first chassis extending along a first longitudinal axis between a first front end and a first rear end;

a collection device mounted on said first chassis and extending between a collection inlet to a collection outlet;

a first holding tank mounted on said first chassis and spaced from said collection device, said first holding tank including a first tank inlet and a first tank outlet;

a conveying system extending between a conveying inlet communicating with said collection outlet and a conveying outlet communicating with said first tank inlet;

a first spraying system extending along said conveying system between said conveying inlet and said conveying outlet;

wherein said conveying system extends along a tortured path and includes a plurality of sections extending in opposite directions and wherein said first spraying system includes spray jets disposed along said plurality of sections extending in opposite directions; and wherein said plurality of sections of said conveying system further comprises a first section and a second section, wherein said first section and said second section extend in opposite vertical directions.

2. The snow-to-slurry conversion apparatus of claim 1 wherein said first section and said second section extend in opposite horizontal directions.

3. The snow-to-slurry conversion apparatus of claim 2 wherein said first section and said second section are stacked with respect to one another.

4. The snow-to-slurry conversion apparatus of claim 1 wherein said first section and said second section are adjacent to one another along said first longitudinal axis.

5. The snow-to-slurry conversion apparatus of claim 1 wherein said first section being a chute directing downward movement of snow.

6. The snow-to-slurry conversion apparatus of claim 5 further comprising:

a crusher disposed along said first section.

7. The snow-to-slurry conversion apparatus of claim 5 wherein said second section includes a first moving device configured to direct snow toward said first front end of said first chassis.

8. A snow-to-slurry conversion apparatus comprising:

a first chassis extending along a first longitudinal axis between a first front end and a first rear end;

a collection device mounted on said first chassis and extending between a collection inlet to a collection outlet;

a first holding tank mounted on said first chassis and spaced from said collection device, said first holding tank including a first tank inlet and a first tank outlet;

a conveying system extending between a conveying inlet communicating with said collection outlet and a conveying outlet communicating with said first tank inlet;

a first spraying system extending along said conveying system between said conveying inlet and said conveying outlet;

wherein said conveying system extends along a tortured path and includes a plurality of sections extending in opposite directions and wherein said first spraying system includes spray jets disposed along said plurality of sections extending in opposite directions;

wherein said plurality of sections of said conveying system further comprises a first section being a chute directing downward movement of snow, a second section including a first moving device configured to direct snow toward said first front end of said first chassis, and a third section including a second moving device configured to direct snow upward.

9. The snow-to-slurry conversion apparatus of claim 8 wherein said plurality of sections of said conveying system further comprises:

a fourth section including a third moving device configured to direct snow toward said first rear end of said first chassis.

10. A snow-to-slurry conversion apparatus comprising:

a first chassis extending along a first longitudinal axis between a first front end and a first rear end;

a collection device mounted on said first chassis and extending between a collection inlet to a collection outlet;

a first holding tank mounted on said first chassis and spaced from said collection device, said first holding tank including a first tank inlet and a first tank outlet;

a conveying system extending between a conveying inlet communicating with said collection outlet and a conveying outlet communicating with said first tank inlet;

a first spraying system extending along said conveying system between said conveying inlet and said conveying outlet;

wherein said conveying system extends along a tortured path and includes a plurality of sections extending in opposite directions and wherein said first spraying system includes spray jets disposed along said plurality of sections extending in opposite directions;

a second chassis extending along a second longitudinal axis between a second front end and a second rear end, said second chassis configured to be releasibly coupled to said first chassis;

a second holding tank mounted on said second chassis, said second holding tank including a second tank inlet and a second tank outlet, said second tank inlet communicating with said first tank outlet;

a first pumping device operably disposed to pump snow and water out of said first holding tank through said first tank outlet and into said second tank inlet; and a second spraying system extending through said second holding tank.

11. The snow-to-slurry conversion apparatus of claim 10 further comprising:

a plurality of baffles disposed in said second holding tank.

12. The snow-to-slurry conversion apparatus of claim 10 further comprising:

at least one moving device positioned to move debris from said first holding tank upstream of said first tank outlet and said second tank inlet.

13. The snow-to-slurry conversion apparatus of claim 10 wherein a vertical gap is defined between said first tank outlet and said second tank inlet.

14. The snow-to-slurry conversion apparatus of claim 10 further comprising:

a grader coupled to both of said first chassis and said second chassis, wherein said collection inlet is positionable to align with an edge of a blade of said grader.

* * * * *